US005533623A

United States Patent [19]

Fischer

[11] Patent Number: 5,533,623

[45] Date of Patent: Jul. 9, 1996

[54] NESTABLE TRAY WITH DESTACKING FEATURE

[75] Inventor: Edward F. Fischer, Old Tappan, N.J.

[73] Assignee: Oak Tree Packaging Corporation, Montvale, N.J.

[21] Appl. No.: 491,344

[22] Filed: Jun. 30, 1995

[51] Int. Cl.[6] ..... B65D 21/02

[52] U.S. Cl. ..... 206/518; 206/505; 206/506; 206/519; 229/114

[58] Field of Search ..... 229/114, 918; 206/505, 506, 518, 519

[56] References Cited

U.S. PATENT DOCUMENTS

| | | | |
|---|---|---|---|
| 1,221,789 | 4/1917 | Brown | 206/518 |
| 2,588,455 | 3/1952 | Adams | 206/519 |
| 2,667,422 | 1/1954 | Kauffman | 206/519 |
| 3,623,651 | 11/1971 | Marcan | 206/519 |
| 3,866,816 | 2/1975 | Bemiss | 206/519 |
| 4,049,188 | 9/1977 | Persson | 206/519 |
| 4,331,238 | 5/1982 | Hanko et al. | 206/518 |
| 4,498,585 | 2/1985 | Gordon et al. | 206/519 |
| 4,714,164 | 12/1987 | Bachner | 206/519 |
| 4,720,013 | 1/1988 | Nichols et al. | 206/506 |
| 4,804,092 | 2/1989 | Jones | 206/506 |

FOREIGN PATENT DOCUMENTS

| | | | |
|---|---|---|---|
| 198037 | 5/1923 | United Kingdom | 206/519 |

*Primary Examiner*—Gary E. Elkins
*Attorney, Agent, or Firm*—William H. Holt

[57] ABSTRACT

A package of nested paperboard trays each formed from a unitary blank and having extension tabs on side panels for engaging a subjacent tray for restricting the amount of nesting, thereby improving the ease of mechanically or manually extricating individual trays from the package incident to a filling operation during which product is placed within the individual trays.

12 Claims, 2 Drawing Sheets

NESTABLE TRAY WITH DESTACKING FEATURE

This invention relates to a tray of the type having a bottom panel portion and a plurality of side wall panels which extend upwardly and slightly outwardly from the bottom panel so that a plurality of such trays may be stacked in nested relation to each other to minimize or reduce the overall volume occupied by a package comprised of a plurality of such trays and thereby also provide protection against damage during shipping and handling by the creation of a high density package of stacked trays.

More particularly, the trays are of the type that are used for packaging products to provide solidity or support for a plurality of individual products packaged for retail distribution and which are usually provided with an overwrap of transparent and/or flexible wrapping for visual presentation of the product, the improvement comprising the provision of means for aiding in the separation, or unstacking, or denesting of individual trays from a stack of such trays without undue difficulties during introduction and assembly of product either mechanically or manually into the individual trays.

BACKGROUND OF THE INVENTION

Nestable trays are not new. It is also not new to provide some type of construction to aid in the separation or unstacking of such trays. Prior an examples are known from U.S. Pat. Nos. 4,714,164 showing destacking tabs that are slit and folded to keep the trays from over-nesting; 3,062,428 showing a container with a separate connector strip to allow for flaring of the side walls during nesting; 4,221,324 showing a shallow stackable tray having a series of tonics formed on side and end walls for fitting inside the walls of the lower tray to minimize nesting and lateral displacement of the trays.

SUMMARY OF THE INVENTION object of the invention is to provide a blab, formed of paperboard and the like, which can be erected for forming a shallow tray having a bottom panel and a plurality of side wall panels which extend upwardly and slightly outwardly from the bottom panel so that a plurality of like trays may be partially nested, one within the other, for providing a substantially dense package of nested trays for minimizing the volume thereof, for providing protection against damage during shipment of such a package, and for providing the individual trays with means for aiding in mechanically, or manually, unstacking the trays, one at a time, incident to filling the trays with product in an assembly line type of operation.

Another object of the invention is to provide a blank for a nestable tray wherein the blank includes a bottom panel having peripheral edges thereof defined by a plurality of peripheral fold lines, a plurality of side panels each having a base edge and a free edge, the side panels having their base edge attached to the bottom panel along respective ones of the peripheral fold lines, adjacent ones of the side panels being separated from each other by respective cut lines extending outwardly from the bottom panel, one panel of the adjacent ones of side panels including an attachment flap connected thereto along a fold line extension, and the other panel of adjacent ones of side panels including an extension tab extending coplanar therewith and along a respective free edge thereof, and the extension tab being separated from the attachment flap by a respective one of the cut lines.

A further object of the invention is to provide a blank as set out above wherein the blank is generally rectangular and includes a series of four side panels, a first pair of said side panels disposed at opposite sides of the bottom panel and each including a pair of attachments, and a second pair of side panels each including along its free edge a pair of anti-nesting extension tabs.

Another object of the present invention is to provide a nestable tray comprising a bottom panel having a plurality of fold lines defining the periphery thereof, a plurality of side panels attached to the bottom panel along the fold lines, the side panels extending away from and tapering outwardly from the bottom panel, adjacent pairs of the side panels being separated from each other by respective cut lines, one side panel of the adjacent pairs of side panels including an extension tab extending coplanar therewith, the other side panel of the adjacent pairs of side panels including an attachment panel connected along a fold line and turned inwardly for being disposed adjacent an inside surface of the mentioned one side panel inwardly from the extension tab, and securing means for securing the attachment panel to the inside surface of the mentioned one side panel.

Additional objects of the invention are to provide the aforementioned nestable tray with securing means comprised of adhesive, providing the cut lines as zig-zag lines for providing the extension tabs with an outwardly opening V-shaped notch, constructing the tray from a single piece of paperboard and including an anti-nesting, or destacking, extension tab extending outwardly at each corner thereof.

A still further object of the invention is to provide a package of nested trays wherein each tray comprises respective bottom panels and a series of respective side walls extending outwardly from their bottom panel in diverging fashion so that the package of nested trays occupies a reduced volume of space and provides against deformation of the trays, each of the trays having at least a first side panel which includes outwardly extending and coplanar extension tab means for engaging with a subjacent tray for limiting the extent of nesting of the respective trays.

An additional object of the invention is to provide such a package of nested trays wherein each of the trays includes a second side panel disposed adjacent to the first mentioned side panel with the second side panel including an attachment flap integral therewith and having means for securing the attachment flap to the first side panel.

DETAILED DESCRIPTION OF THE INVENTION

Figure 1:
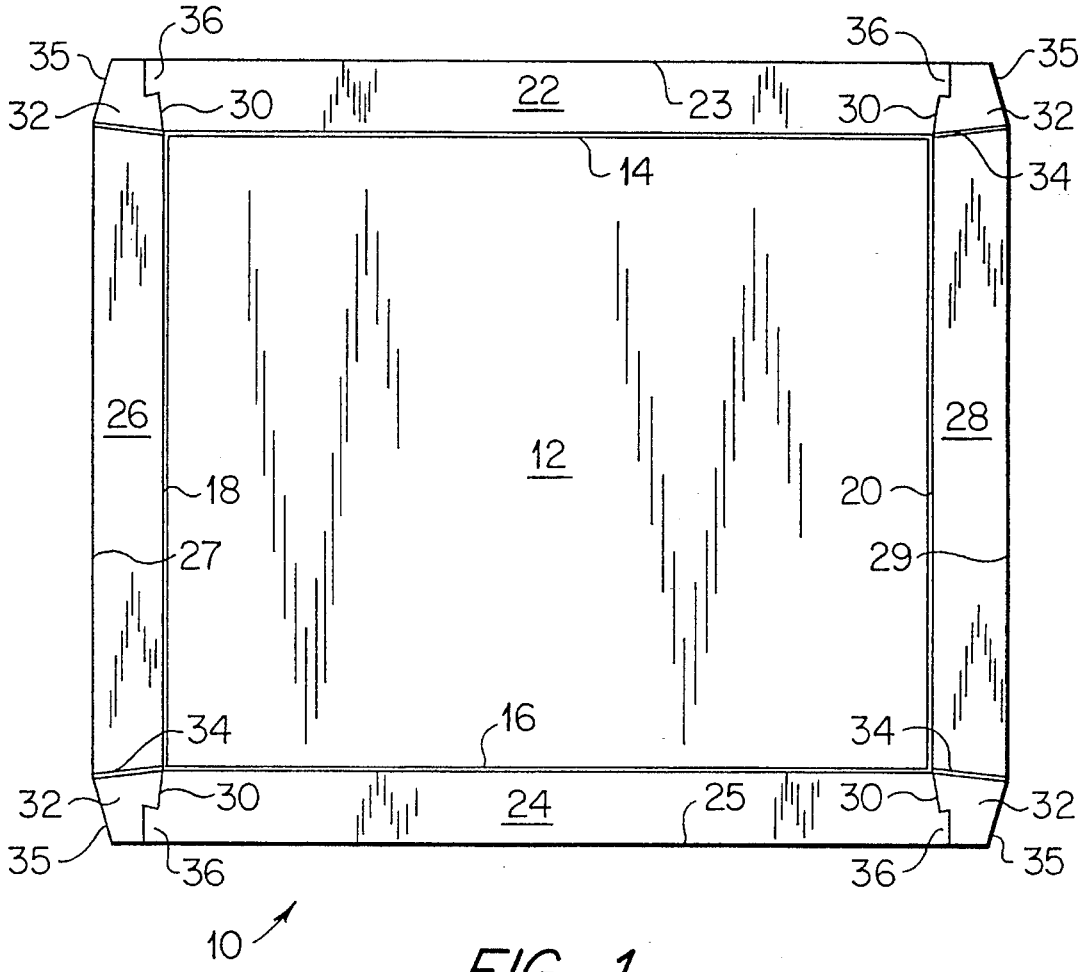
FIG. 1 is a plan view of a paperboard blank for forming a tray in accordance with the invention.

As is best shown in FIG. 1, a blank for a tray, generally indicated by the numeral 10, which is preferably cut or stamped from stock material such as paperboard, or the like, includes a bottom panel 12 having a plurality of peripheral edges defined by a plurality of peripheral fold lines 14, 16, 18 and 20 coincident therewith. A plurality of side panels 22, 24, 26 and 28 each have a base edge attached to the bottom panel 12 along, and defined by, the fold lines 14, 16, 18 and 20. Side panels 22, 24, 26 and 28 extend outwardly from bottom panel 12 and terminate at respective free edges 23, 25, 27 and 29.

Figure 2:
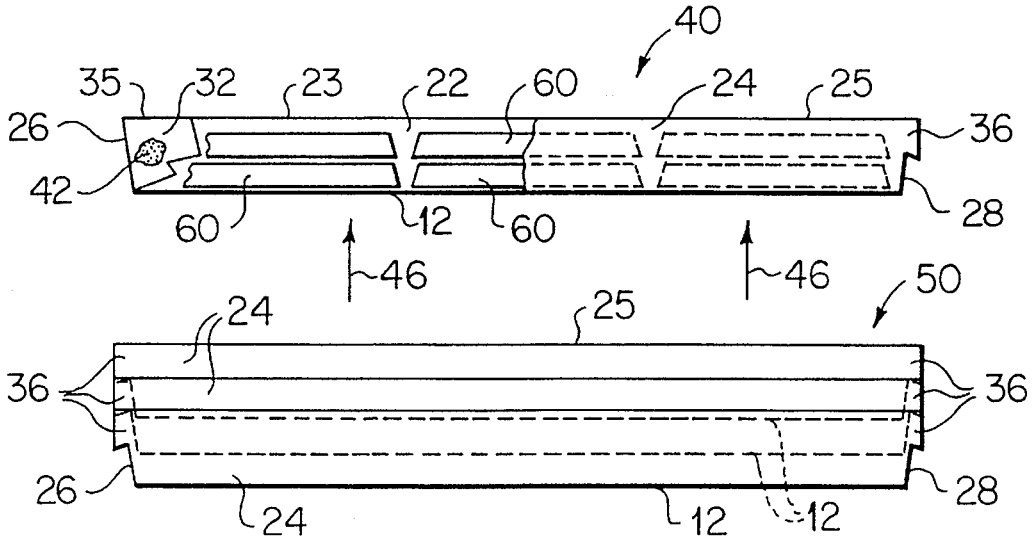
FIG. 2 is an exploded view of a package of nestable trays formed in accord with the invention.

Each of the corners of blank 10 include a generally Z-shaped, three-part, zig-zag cut line 30 for separating spaced side panels 22 and 24 from spaced side panels 26 and 28. Cut lines 30 function to provide side panels 26 and 28 with attachment flaps 32 which extend from each end of the respective side panels 26 and 28 along fold line extensions 34, 34. It is to be noted that the respective fold line extensions 34, 34 for each of side panels 26 and 28 diverge slightly outwardly with respect to each other. Each of the attachment flaps 32, 32 is provided with a free edge 35 extending at an angle to free edges 27 and 29. As a result, when the blank 10 is folded to form a tray, generally indicated by the numeral 40 in FIG. 2, the free edges 35, 35 align with free edges 23 and 25 of side panels 22 and 24 and cause side panels 22, 24, 26 and 28 to extend upwardly and outwardly from bottom panel 12 thus forming tray 40 to be tapered and nestable with a plurality of like trays for forming a package of nested trays 40, the package of trays being generally indicated by the numeral 50 in FIG. 2. As is shown at the upper left portion of FIG. 2, attachment flaps 32 are each provided with a spot of adhesive material 42 which will secure the attachment flaps 32, 32 to the inside surface of side panels 22 and 24 thus maintaining trays 40 in erected condition. Adhesive material 42, in the form of glue or the like is a preferred securing means; however, it is to be understood that other securing means may be utilized such as staples, clips or heat sealable plastic coatings.

Figure 3:
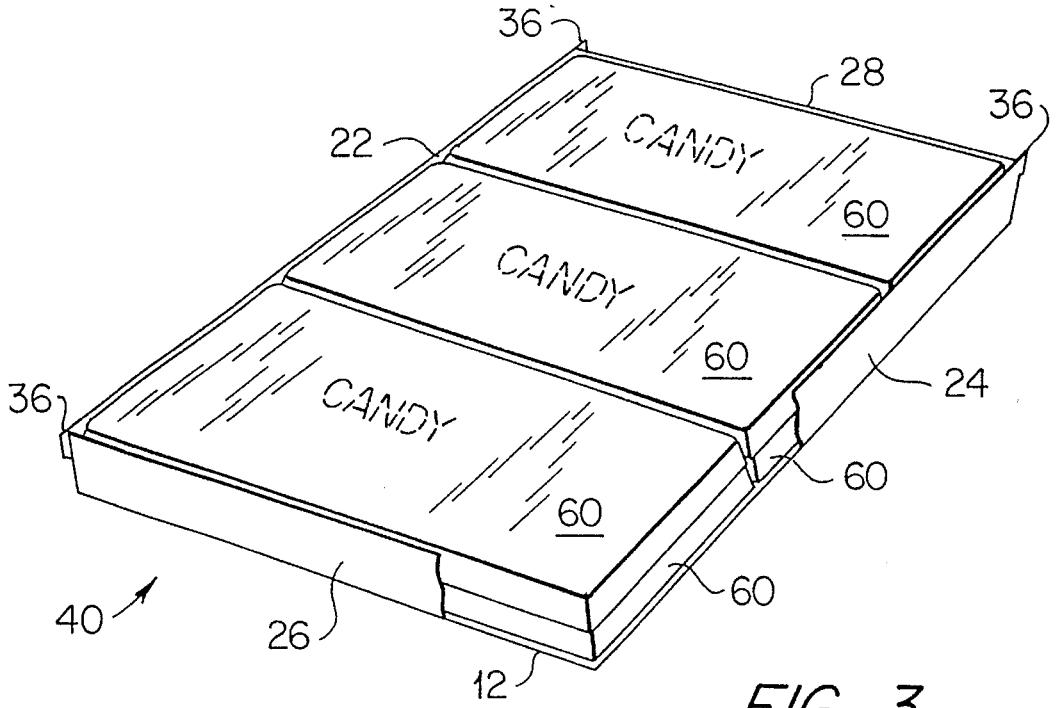
FIG. 3 illustrates a single tray, formed in accordance with the invention, containing a plurality of candy bars ready for receiving an overwrap.
Figure 4:
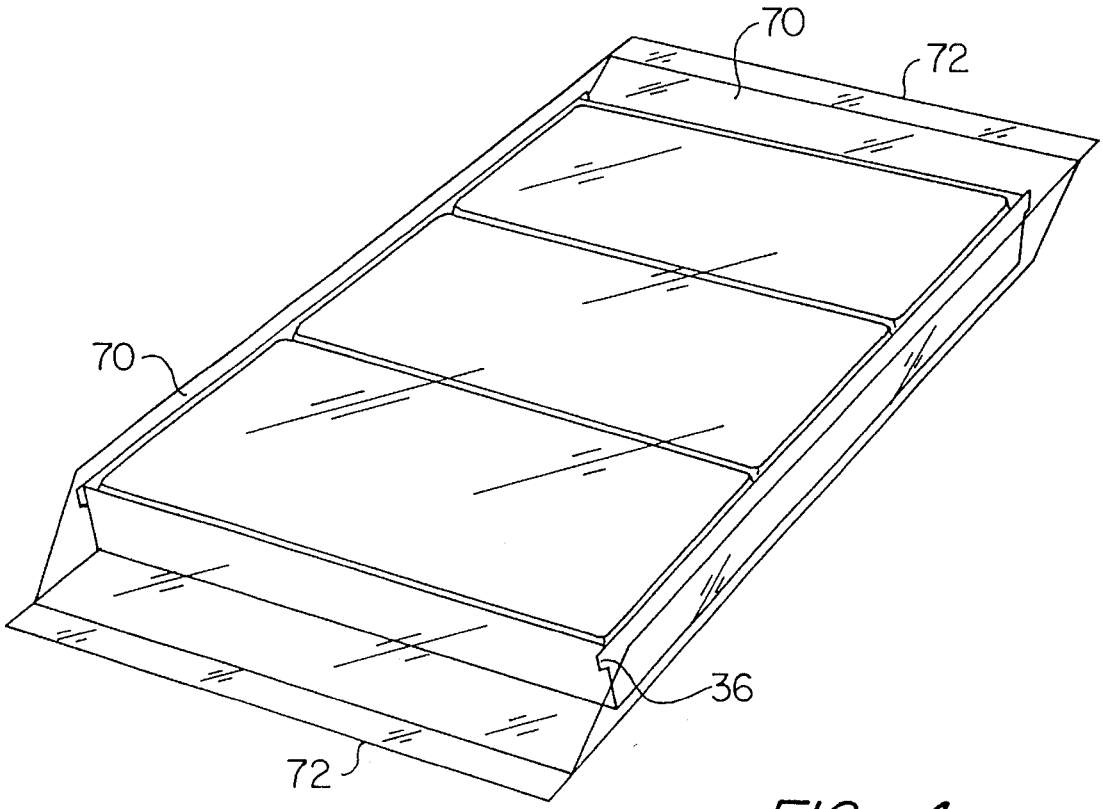
FIG. 4 illustrates a completed package including a flexible wrap encircling the tray for retaining product therein.

Cut lines 30 also define extension tabs 36 extending outwardly at opposite ends of side panels 22 and 24 for providing an important feature of the present invention. Extension tabs 36 extend coplanar with their respective side panels 22 and 24. The zig-zag cut lines 30 form the extension tabs 36 with an outwardly opening, generally V-shaped notch 44 which, in the manner shown in FIG. 2, engage the top free edges of side panels 26 and 28 to limit or restrict the amount of nesting of trays 40 when forming tray package 50. The extension tabs 36 support each tray 40 somewhat loosely within the subjacent tray as is evident from the series of slightly spaced bottom panels 12 shown in FIG. 2. As a result, the plurality of trays 40, in package 50, can be easily separated, destacked, or denested, either by mechanical means, or manually, as part of a filling operation wherein a topmost tray 40 is moved upwardly as is indicated by the arrows 46 in FIG. 2, and a product, for example a plurality of candy bars 60, may be placed within the individual tray. In this regard, see FIG. 3 which illustrates the tray 40 as containing six candy bars 60. The candy bars, or other such products, are retained within the tray 40 by, for example, flexible packaging material in the form of a flexible pouch, bag or overwrap 70 shown in FIG. 4. The overwrap 70 may be crimped, or heated sealed along seams 72 at opposite ends thereof. While the overwrap 70 is illustrated as being generally transparent, it will be understood that printing and color may be included for identifying the contents thereof.

While the instant invention has been shown and described herein in a practical and presently preferred embodiment, it is to be understood that various changes and modification may be made without departing from the spirit and scope of the invention as defined in the following claimed subject matter.

I claim:

1. A blank for a nestable tray, said blank including a bottom panel having peripheral edges thereof defined by a plurality of peripheral fold lines, a plurality of side panels each having a base edge and a free edge, said side panels having their base edge attached to said bottom panel along respective ones of said peripheral fold lines, adjacent ones of said side panels being separated from each other by respective cut lines extending outwardly from said bottom panel, one panel of said adjacent ones of said side panels including an attachment flap connected thereto along a fold line extension, and said other panel of adjacent ones of said side panels including an extension tab extending coplanar therewith and along a respective free edge thereof, said extension tab being separated from said attachment flap by a respective one of said cut lines.

2. A blank as defined in claim 1 wherein an adjacent pair of said cut lines extend outwardly from one of said peripheral fold lines and diverge outwardly from each other for defining opposite ends of one of said other side panels and for providing said one of said other side panels with a free edge that is longer than its respective base edge.

3. A blank as defined in claim 2 wherein said bottom panel is generally rectangular and said side panels are four in number, a first pair of said side panels being disposed at opposite edges of said bottom panel and each including a pair of said attachment flaps, and a second pair of said side panels each including along its free edge a pair of said extension tabs.

4. A blank as defined in claim 1 wherein said cut lines are generally zig-zag in shape.

5. A nestable tray comprising a bottom panel having a plurality of fold lines defining the periphery thereof, a plurality of side panels attached to said bottom panel along said fold lines, said side panels extending away from and tapering outwardly from said bottom panel, adjacent pairs of said side panels being separated from each other by respective cut lines, one side panel of said adjacent pairs of side panels including an extension tab extending coplanar therewith, the other side panel of said adjacent pairs of side panels including an attachment panel connected thereto along a fold line and turned inwardly for being disposed adjacent an inside surface of said one side panel inwardly from said extension tab, and securing means for securing said attachment panel to said inside surface of said one side panel.

6. A nestable tray as defined in claim 5 wherein said securing means is comprised of adhesive.

7. A nestable tray as defined in claim 5 wherein said cut lines are zig-zag lines for providing said extension tab with an outwardly opening V-shaped notch.

8. A nestable tray as defined in claim 5 wherein said tray is constructed from a single piece of paperboard.

9. A nestable tray as defined in claim 5 wherein said tray contains a product disposed therein, and a flexible wrap encircling said tray and product without interference from said extension tabs.

10. A nestable tray as defined in claim 5 wherein said tray is rectangular in plan and includes one said extension tab extending outwardly at each corner thereof.

11. A package of nested trays, said trays each comprising respective bottom panels and a series of respective side walls extending outwardly from their bottom panel in diverging fashion so that said package of nested trays occupies a reduced volume of space and provides protection against deformation of said trays, each of said trays having at least a first side panel which includes outwardly extending and co-planar extension tab means for engaging with an adjacent tray for limiting the extent of nesting of the respective trays.

12. A package of nested trays as defined in claim 11 wherein each of said trays includes a second side panel is disposed adjacent to said first side panel and said second side panel includes an attachment flap integral therewith, and means securing said attachment flap to said first side panel.

* * * * *